US006390652B1

(12) United States Patent
Echito

(10) Patent No.: US 6,390,652 B1
(45) Date of Patent: May 21, 2002

(54) PORTABLE MOUNTING LIGHT UNIT

(75) Inventor: Cory Echito, San Diego, CA (US)

(73) Assignee: Westek Assocaites, Inc., San Diego, CA (US)

( * ) Notice: Subject to any disclaimer, the term of this patent is extended or adjusted under 35 U.S.C. 154(b) by 0 days.

(21) Appl. No.: 09/475,411

(22) Filed: Dec. 30, 1999

(51) Int. Cl.[7] ..... F21V 21/00; F21S 4/00

(52) U.S. Cl. ..... 362/374; 362/219; 362/222; 362/223; 362/133; 362/260; 362/368

(58) Field of Search ..... 362/374, 220–225, 362/133, 147, 394, 260, 217, 362, 375, 368, 219; 439/417, 419, 425, 404, 505, 235

(56) References Cited

U.S. PATENT DOCUMENTS 4,092,562 A * 5/1978 Campbell ..... 315/189
4,563,729 A * 1/1986 Jendrewski ..... 362/218
4,799,898 A 1/1989 Schick
5,499,930 A * 3/1996 Cieri ..... 439/417
5,552,348 A * 9/1996 Wu ..... 439/419
5,640,069 A * 6/1997 Nilssen ..... 315/209 R
5,842,775 A * 12/1998 Roorda et al. ..... 362/294
6,033,085 A * 3/2000 Bowker ..... 362/223
6,198,228 B1 * 3/2001 Nilssen ..... 315/185 R
6,206,981 B1 * 7/2001 Fiene ..... 362/147

OTHER PUBLICATIONS

"Gilbert Polarized Slide–on Plug" instruction sheet, Cat. #33P, Gilbert Manufacturing Co., Inc., South Hill, VA 23970.

* cited by examiner

*Primary Examiner*—Thomas M. Sember
*Assistant Examiner*—David V. Hobden
(74) *Attorney, Agent, or Firm*—Brown Martin Haller & McClain, LLP

(57) ABSTRACT

A portable mounting light unit with provision for unit-to-unit interconnection comprising a housing having a mounting surface, at least two insulation displacement connectors mounted at diametrically opposite portions of the housing adjacent to the mounting surface, a lamp assembly, a diffuser cover for attachment over the lamp assembly, and at least one fastener access for attaching the housing to the supporting structure. The insulation displacement connectors allow for unit-to-unit interconnection with the ability to custom fit each interconnecting cord.

16 Claims, 3 Drawing Sheets

PORTABLE MOUNTING LIGHT UNIT

BACKGROUND OF THE INVENTION

Portable lighting has become a useful tool that is apparent in all aspects of daily life. Portable lights have typically utilized incandescent or halogen bulbs. More recently, manufacturers have found a cheaper, safer, and longer lasting alternative with fluorescent lamps. For this reason, fluorescent lighting has been incorporated into the portable lighting industry.

In recent years, low wattage accent lighting has become popular in home decorating. In one form of this accent lighting, fluorescent lighting units are mounted to provide lighting for cabinets, artwork, displays, and workshops. It is important that the lighting units of this general type have a low profile so that they will be concealed from view when mounted to the downwardly facing surface of a cabinet for example.

Most fluorescent lighting units are mounted in the ceiling or to a stationary object. These lighting units typically include a housing, a lamp, a diffuser cover, and a lamp assembly. In most designs, the ballast is mounted above the lamp to convert and supply power. The diffuser cover attaches to the housing providing protection for the lamp and the interior of the lighting unit. The positioning of the ballast makes it difficult to install or remove the lighting unit because access to the mounting fasteners usually requires the removal of the diffuser cover, lamp, and the ballast. In addition, the positioning of the ballast above the lamp forces the user to remove the lamp in a downward motion during replacement, creating a greater risk that the lamp will accidentally be dropped.

Many designs of these lighting units have big, bulky enclosures that cover the lamp, often called diffuser covers. The diffuser covers are made of a hard, rigid plastic or similar material that is not flexible. This lack of flexibility makes replacement and maintenance of the lighting units difficult because sufficient hand strength is needed to remove the diffuser cover from the lighting unit. The inflexible material creates a risk of danger because someone without the proper hand strength might resort to prying or pulling the diffuser cover, resulting in injury to them or the diffuser cover.

Accent lighting typically incorporates the use of multiple lighting units. The problem most often encountered is that each lighting unit requires a separate power source. This makes the positioning of lighting units difficult and cumbersome because each lighting unit must be positioned by a power outlet or connected by lengthy extension cords.

For the reasons described above, there remains a need for a portable mounting light unit that allows for easy and safe removal, mounting, lamp replacement, diffuser cover removal and replacement, and unit-to-unit interconnection with the ability to custom fit each interconnecting cord.

SUMMARY OF THE INVENTION

It is an advantage of the present invention to provide a portable mounting light unit that provides easy access to the mounting fasteners allowing for quick and simple installation and removal.

It is a further advantage of the present invention to provide a portable mounting light unit with a lighting assembly that has the ballast mounted from behind the lamp, thereby allowing for easy gripping and removal of the lamp.

It is still another advantage of the present invention to provide a portable mounting light unit that provides a flexible diffuser cover with flexible latches to allow easy installation and removal of the diffuser cover.

Another advantage of the present invention is to provide a portable mounting light unit that allows unit-to-unit interconnection with the ability to custom fit each interconnecting cord.

Yet another advantage of the present invention is to provide a portable mounting light unit that is safe, compact, and simple-to-use.

In an exemplary embodiment, the portable mounting light unit comprises a housing having a mounting surface, at least two insulation displacement connectors mounted at diametrically opposite portions of the housing adjacent to the mounting surface, a lamp assembly mounted within the housing, a diffuser cover, and at least one fastener access for attaching the housing to the supporting structure.

The housing is elongated in shape with a top portion and a bottom portion that are secured together by a plurality of fastening screws. The housing is preferably be made of a lightweight, durable plastic, or other similar material. The housing has a recess for placement of the lamp assembly, and diffuser cover. The recess has at least one fastener access in the back corners of the housing. The fastener access is in the shape of an angular notch. The fastener access has a plurality of fastener openings that allow the portable mounting light unit to be mounted to almost any surface with the use of screws or other fastening means. A benefit of the fastener access is to provide enough room for the insertion of a human thumb or finger to allow the easy installation and maintenance of the lamp while the portable mounting light unit is mounted. In addition, the fastener access provides for the insertion of a screwdriver or other fastening device allowing the portable mounting light unit to be moved and remounted without having to remove the lamp.

The lamp assembly is mounted in the interior of the housing. The lamp assembly includes a ballast, a lamp, and a plurality of sockets for receiving and supporting the lamp. The ballast is positioned directly behind the lamp. The placement of the ballast behind the lamp is an important advantage in overcoming a long-time problem. Most ballasts are located directly above the lamp so that when the lamp is removed, the lamp falls in a downward direction creating a risk of injury if the lamp is not property gripped. When the lamp is removed with ballast positioned behind the lamp, the lamp is removed in a forward direction allowing for easy gripping and reducing the risk of dropping the lamp.

Additionally, the ballast in this positioning shields the lamp so that the portable mounting unit can be placed under the rim of a cabinet and direct the light against the splash for indirect lighting, thereby providing forward illumination, as compared to most commercial designs where the ballast is above the lamp so the lamp is exposed on three sides providing less effective illumination in the desired direction.

The lamp is a fluorescent tube type, preferably a tri-phosphor fluorescent tube which uses less energy and lasts longer. The spectrum emitted from fluorescent lamps is very close to natural light which is desired when used for accent lighting. The plurality of sockets for receiving and supporting the lamp slightly protrude from the interior of the recess. The lamp is inserted into the sockets with the lamp pins parallel to the sockets. The lamp is secured in position by twisting the lamp until the lamp pins are perpendicular with the sockets.

The diffuser cover is parabolic in shape and is attached over the lamp assembly. The diffuser cover protects the lamp from damage while also reducing glare and evenly distributing light. The diffuser cover will preferably be made of a flexible, light transmitting plastic or other similar material. Flexible latches protrude from the inside edges allowing the diffuser cover to be attached to the housing by snapping the flexible latches into recessed slots located near the top of the housing. The flexible latches will preferably be located directly over the fastener openings. The flexible latches allow for easy installation and removal of the diffuser cover without the need for a significant amount of hand strength, as compared to most typical diffuser covers which are a hard plastic and require a significant amount of hand strength to remove.

One unique feature of the portable mounting light unit is the provision for unit-to-unit interconnection. Unit-to-unit interconnection is possible due to at least two insulation displacement connectors (IDC's) mounted diametrically opposite portions of the housing adjacent to the mounting surface. The IDC's comprise of a recess, a plurality of insertion prongs, and a removable slide cover. The frictional engagement feature of the IDC's allow for an electrical cord to be locked into the recess. The electrical cord is inserted into the recess and then bent 90°. The electrical cord is then attached to the insertion prongs which penetrate the electrical cord casing and make contact with the electrical conductors. The removable slide cover is slide over the electrical cord until it locks into place. The electrical cord that connects between each portable mounting light unit can be custom fit, thereby eliminating the problem of tangled, sagging, or excessively long electrical cords. A manually actuable switch can be mounted on the housing for controlling the lamp assembly. Each portable mounting light unit can be independently controlled by the use of their own switch. A power cord can be used solely for controlling power to the portable mounting light unit.

BRIEF DESCRIPTION OF THE DRAWINGS

Understanding of the present invention will be facilitated by consideration of the following detailed description of a preferred embodiment of the present invention taken in conjunction with the accompanying drawings, in which like numerals refer to like parts and in which.

DETAILED DESCRIPTION OF THE INVENTION

Figure 1:
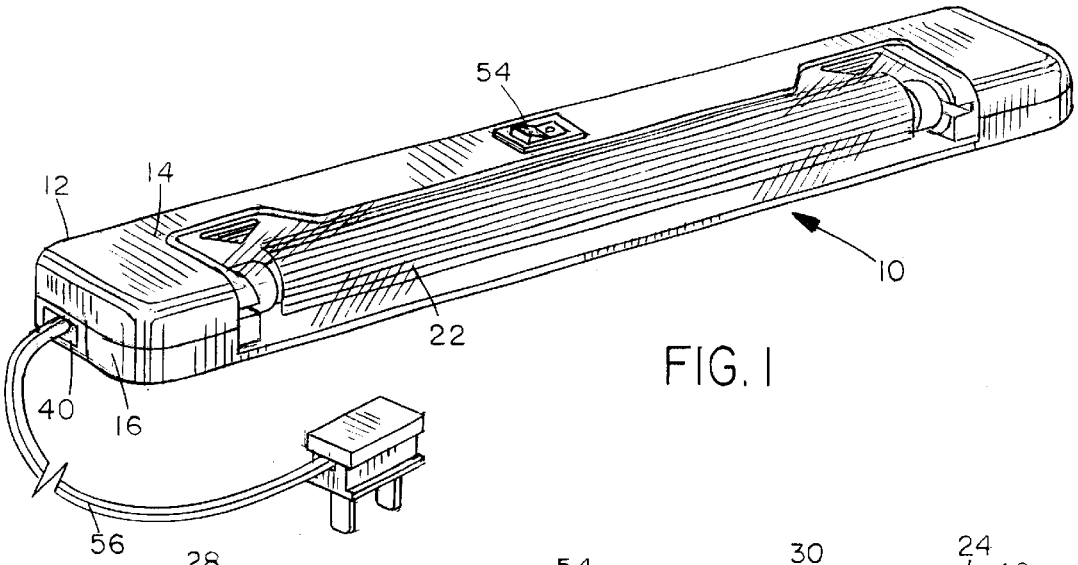
FIG. 1 is a perspective view of the unit.
Figure 2:
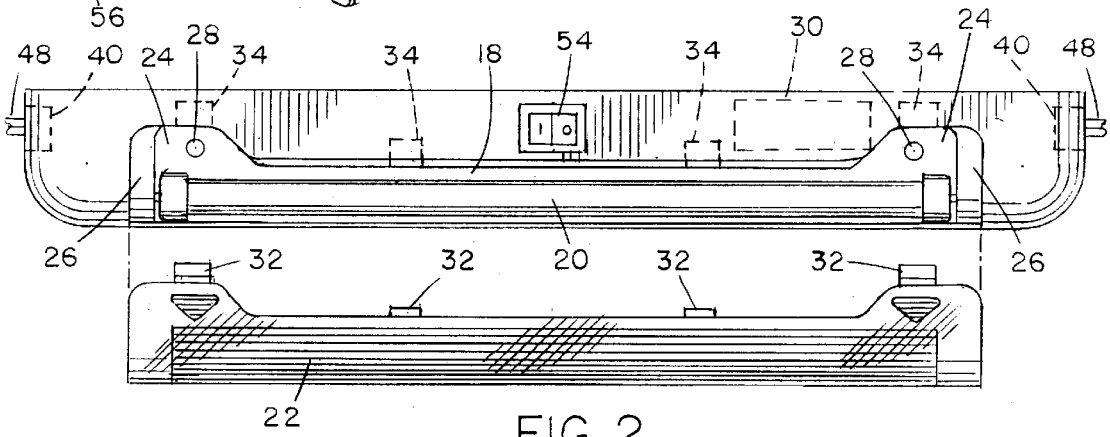
FIG. 2 is a bottom plan view thereof with the diffuser cover separated.

As illustrated in FIGS. 1 and 2, the portable mounting light unit 10 comprises a housing 12 having a mounting surface, at least two insulation displacement connectors 40 mounted at diametrically opposite portions of the housing 12, a lamp assembly 26 mounted within the housing 12, a diffuser cover 22, and at least one fastener access 24 for attaching the housing 12 to a supporting structure.

Figure 3:
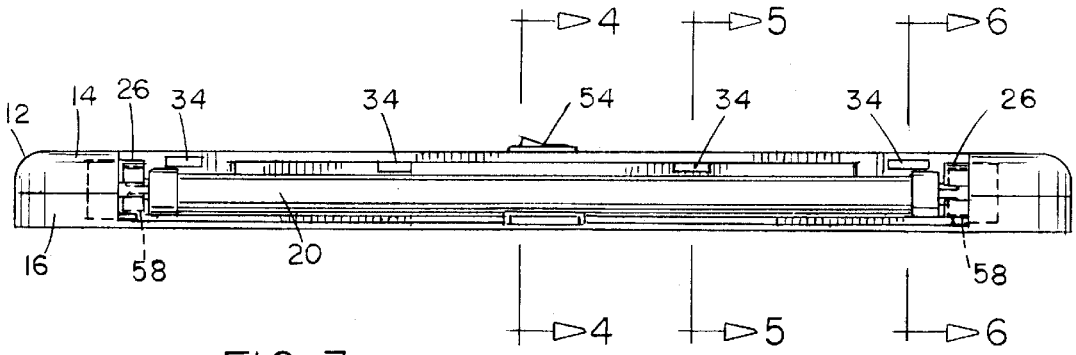
FIG. 3 is a front view of the unit without the diffuse cover.

The housing 12 is elongated in shape with a top portion 14 and a bottom portion 16 that are secured together by a plurality of fastening screws. The housing 12 is preferably be made of a lightweight, durable plastic, or other similar material. The housing 12 has a recess 18 for placement of the lamp assembly 26, and diffuser cover 22 as shown in FIGS. 2 and 3. The recess 18 has at least one fastener access 24 in the back corners of the housing 12. The fastener access 24 is in the shape of an angular notch. The fastener access 24 has a plurality of fastener openings 28 that allow the portable mounting light unit 10 to be mounted to almost any surface with the use of screws or other fastening means. For example, FIG. 7 shows a typical mounting of the portable mounting light unit 10 under an overhead cabinet.

Figure 6:
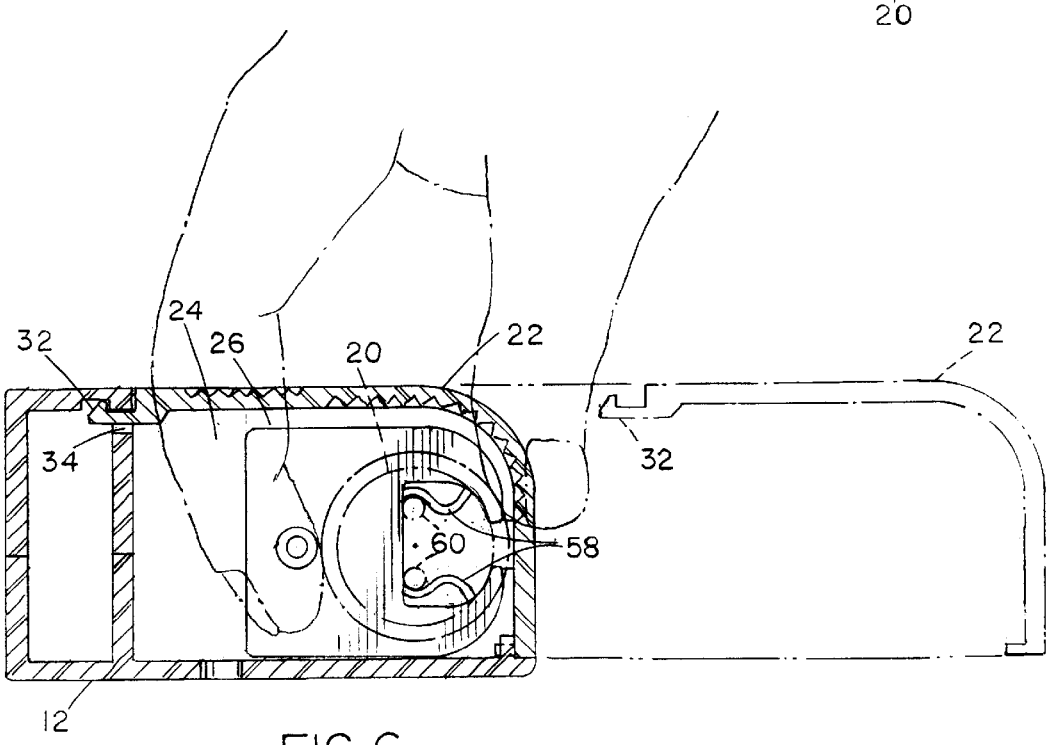
FIG. 6 is an enlarged sectional view taken on line 6—6 of FIG. 3.

A benefit of the fastener access 24 is to provide enough room for the insertion of a human thumb or finger to allow the easy installation and maintenance of the lamp 20 while the portable mounting light unit 10 is mounted as shown in FIG. 6. In addition, the fastener access 24 provides for the insertion of a screwdriver or other fastening device allowing the portable mounting light unit 10 to be moved and remounted without having to remove the lamp 20.

The lamp assembly 26 is mounted in the interior of the housing 12. The lamp assembly 26 includes a ballast 30, a lamp 20, and a plurality of sockets 58 for receiving and supporting the lamp 20. The ballast 30 is positioned directly behind the lamp 20 for the purpose of converting and supplying power to the lamp 20. The placement of the ballast 30 behind the lamp 20 is an important advantage in overcoming a long-time problem. Most ballasts are located directly above the lamp so that when the lamp is removed, the lamp falls in a downward direction creating a risk of injury if the lamp is not properly gripped. When the lamp 20 is removed with ballast 30 positioned behind the lamp 20, the lamp 20 is removed in a forward direction allowing for easy gripping and reducing the risk of dropping the lamp 20 as shown in FIG. 6.

Figure 7:
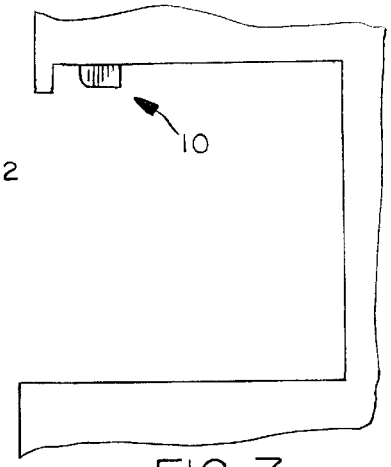
FIG. 7 illustrates a typical mounting of the unit under an overhead cabinet.

Additionally, the ballast 30 in this positioning shields the lamp 20 so that the portable mounting unit 10 can be placed under the rim of a cabinet and direct the light against the splash for indirect lighting, thereby providing forward illumination in the desired location as shown in FIG. 7.

Referring to FIG. 6, the lamp 20 is a fluorescent type tube, preferably a tri-phosphor fluorescent tube which uses less energy and lasts longer. The plurality of sockets 58 for receiving and supporting the lamp 20 slightly protrude from the interior of the recess 18. The lamp 20 is inserted into the sockets 58 with the lamp pins 60 parallel to the sockets. The lamp 20 is secured in position by twisting the lamp 20 until the lamp pins 60 are perpendicular with the sockets 58.

Referring to FIGS. 2 and 3, the diffuser cover 22 is parabolic in shape and is attached over the lamp assembly 26. The diffuser cover 22 protects the lamp 20 from damage while also reducing glare and evenly distributing light. The diffuser cover 22 will preferably be made of a flexible, light transmitting plastic or other similar material. Flexible latches 32 protrude from the inside edges allowing the diffuser cover 22 to be attached to the housing 12 by snapping the flexible latches 32 into recessed slots 34 located near the top of the housing 12. The flexible latches 32 will preferably be located directly over the fastener openings 28. The flexible latches 32 allow for easy installation and removal of the diffuser cover 22 without the need for a significant amount of hand strength, as compared to most typical diffuser covers which are a hard plastic and require a significant amount of hand strength to remove.

Figure 8:
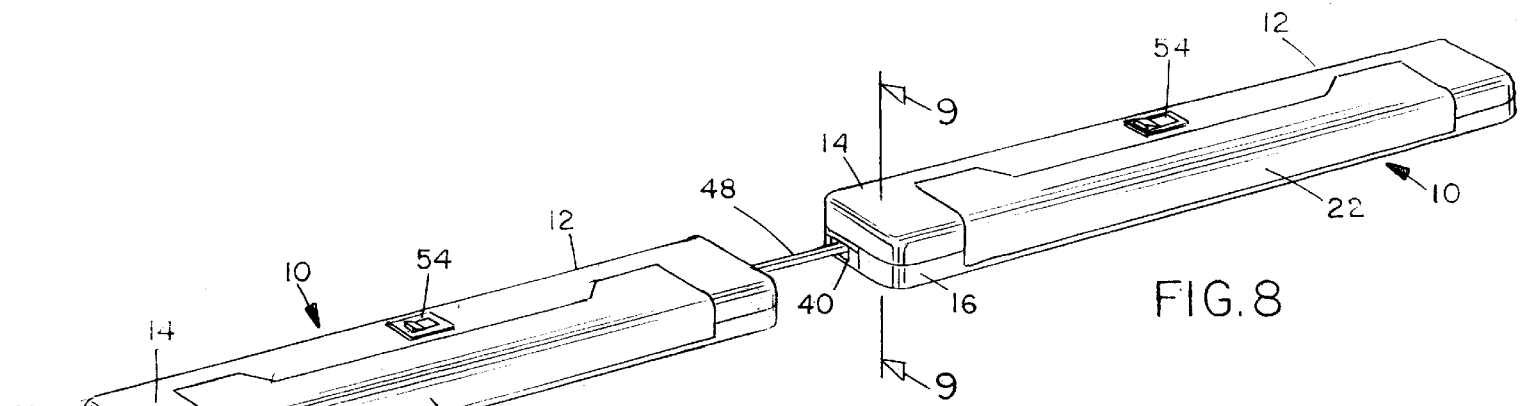
FIG. 8 is a perspective view showing two units connected together.
Figure 9:
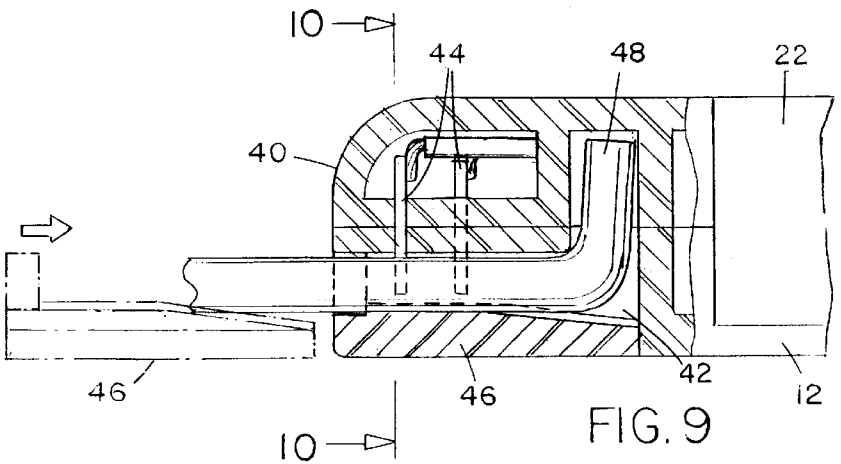
FIG. 9 is an enlarged sectional view taken on line 9—9 of FIG. 8.
Figure 10:
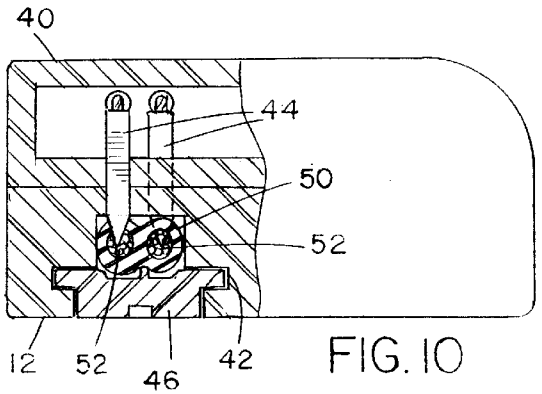
FIG. 10 is a sectional view taken on line 10—10 of FIG. 9.

One unique feature of the portable mounting light unit 10 is the provision for unit-to-unit interconnection with the use of only one electrical power plug as shown in FIG. 8. Unit-to-unit interconnection is possible due to at least two insulation displacement connectors (IDC's) 40 mounted at diametrically opposite portions of the housing 12. Referring to FIGS. 9 and 10, the IDC's 40 comprise of a recess 42, a plurality of insertion prongs 44, and a removable slide cover 46. The frictional engagement feature of the IDC's 40 allow for an electrical cord 48 to be locked into the recess 42. The electrical cord 48 is inserted into the recess 42 and then bent 90°. The electrical cord 48 is then attached to the insertion prongs 44 which penetrate the electrical cord casing 50 and make contact with the electrical conductors 52. The removable slide cover 46 is slide over the electrical cord 48 until it locks into place. The electrical cord 48 connects between each portable mounting light unit 10 to provide power. Since only one electrical power plug 56 is needed on the first portable mounting light unit 10, each subsequent portable mounting light unit 10 can have a custom fit interconnected electrical cord 48. This eliminates the problem of tangled, sagging, or excessively long electrical cords.

Figure 4:
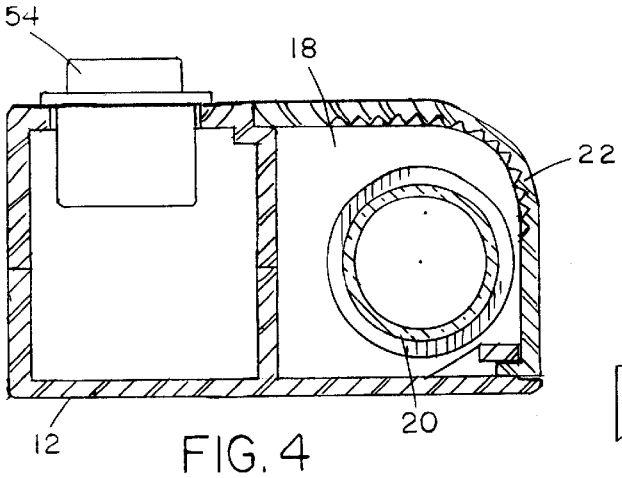
FIG. 4 is an enlarged sectional view taken on line 4—4 of FIG. 3.
Figure 5:
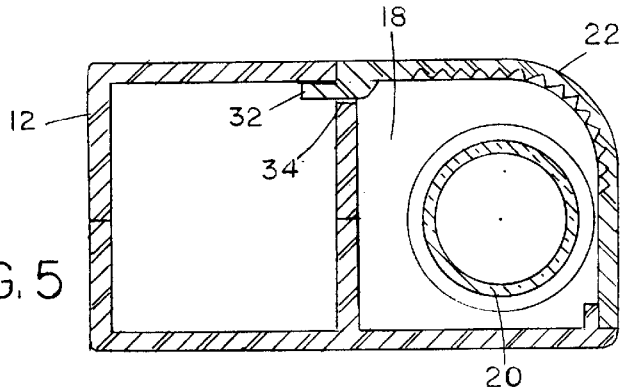
FIG. 5 is an enlarged sectional view taken on line 5—5 of FIG. 3.

A manually actuable switch 54 can be mounted on the housing for controlling the lamp assembly as shown in FIGS. 4 and 5. Each portable mounting light unit 10 can be independently controlled by the use of their own switch. A power cord 56 can be used solely for controlling power to the portable mounting light unit 10.

The portable mounting light unit of the present invention provides many advantages over lighting units currently available. It can be set up with little difficulty, since it is lightweight and easy to handle. It provides unit-to-unit interconnection without tangled, sagging, or excessively long electrical cords. It provides for a flexible, plastic diffuser cover that allows for easy installation and removal. It allows for easy installation and removal of the lamp and the lighting unit while being safe, compact, and simple-to-use.

It will be apparent to those skilled in the art that various modifications and variations may be made in the apparatus and process of the present invention without departing from the spirit or scope of the invention. Thus, it is intended that the present invention cover the modification and variations of this invention provided they come within the scope of the appended claims and their equivalents.

I claim:

1. A portable mounting light unit with provision for unit-to-unit interconnection comprising:

(a) a housing having a mounting surface;

(b) an at least two insulation displacement connectors mounted at diametrically opposite portions of the housing adjacent to the mounting surface;

(c) a lamp assembly mounted within the housing;

(d) a diffuser cover for attachment over the lamp assembly; and (e) an at least one fastener access for attaching the housing to supporting structure.

2. A portable mounting light unit as in claim 1, wherein the housing is a plastic material.

3. A portable mounting light unit as in claim 1, wherein the insulation displacement connectors comprise of a recess for receiving an electrical cord with at least two conductors, a plurality of insertion prongs, and a removable slide cover.

4. A portable mounting light unit as in claim 3, wherein the plurality of insertion prongs penetrate to the electrical conductors of the electrical cord.

5. A portable mounting light unit as in claim 4, wherein the electrical cord is frictionally engaged by the removable slide cover.

6. A portable mounting light unit as in claim 1, wherein the lamp assembly includes a lamp, a ballast positioned behind the lamp, and a plurality of sockets for receiving and supporting the lamp.

7. A portable mounting light unit as in claim 6, wherein the lamp is fluorescent.

8. A portable mounting light unit as in claim 1, wherein the fastener access has a plurality of fastener openings.

9. A portable mounting unit as claimed in claim 8, wherein the diffuser cover is made of a flexible, light transmitting plastic.

10. A portable mounting light unit as in claim 9, wherein the diffuser cover has flexible latches for installation and removal of the diffuser cover.

11. A portable mounting light unit as in claim 10, wherein the flexible latches directly overlie the plurality of fastener openings.

12. A portable mounting light unit as in claim 1, further comprising a manually actuable switch mounted on the housing for controlling the lamp assembly.

13. A portable mounting light unit with provision for unit-to-unit interconnection comprising:

(a) at least two light units for being mounted at selected positions on a supporting surface, each unit comprising an elongated housing having a mounting surface, the housing having a top portion, a bottom portion, and a recess;

(b) a lamp assembly mounted within the housing, the lamp assembly comprising at least one socket for receiving and supporting the lamp;

(c) an at least two insulation displacement connectors mounted at diametrically opposite portions of the housing adjacent to the mounting surface, the insulation displacement connectors comprising a recess for receiving an electrical cord with at least two conductors, a plurality of insertion prongs, and a removable slide cover;

(d) an at least one fastener access for attaching the housing to supporting structure, the fastener access having a plurality of fastener openings;

(e) a diffuser cover for attachment over the lamp assembly, the diffuser cover having flexible latches directly overlying the fastener openings; and (f) a length of cord having a length substantially equal to the distance between opposing insulation displacement connectors of adjacent light unit housings.

14. A portable mounting light unit as in claim 13, wherein the plurality of insertion prongs penetrate to the electrical conductors.

15. A portable mounting light unit as in claim 14, wherein the electrical cord is frictionally engaged by the removable slide cover.

16. A portable mounting light unit as in claim 13, further comprising a manually actuable switch mounted on the housing for controlling the lamp assembly.

* * * * *